US006302535B1

(12) United States Patent
Sturgeon et al.

(10) Patent No.: US 6,302,535 B1
(45) Date of Patent: Oct. 16, 2001

(54) INK CONTAINER CONFIGURED TO ESTABLISH RELIABLE ELECTRICAL CONNECTION WITH A RECEIVING STATION

(75) Inventors: Scott D. Sturgeon, Vancouver, WA (US); Charles R. Steinmetz, Corvallis; David C. Johnson, Portland, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/556,879

(22) Filed: Apr. 19, 2000

(51) Int. Cl.[7] ..... B41J 2/175
(52) U.S. Cl. ..... 347/86
(58) Field of Search ..... 347/85, 86, 87, 347/19, 7; 399/25

(56) References Cited

U.S. PATENT DOCUMENTS

| | | | | |
|---|---|---|---|---|
| 5,182,581 | | 1/1993 | Kashimura et al. | 347/87 |
| 5,552,816 | * | 9/1996 | Oda et al. | 347/86 |
| 5,619,237 | | 4/1997 | Inoue et al. | 347/86 |
| 5,619,239 | | 4/1997 | Kotaki et al. | 347/86 |
| 5,784,088 | | 7/1998 | Ujita et al. | 347/86 |
| 5,812,156 | | 9/1998 | Bullock et al. | 347/19 |
| 5,835,817 | | 11/1998 | Bullock et al. | 399/25 |

FOREIGN PATENT DOCUMENTS

| | | | |
|---|---|---|---|
| 0551752A2 | 7/1993 | (EP) | B41J/2/165 |
| 0590669A1 | 7/1993 | (EP) | B41J/2/165 |

OTHER PUBLICATIONS

A copy of PCT International Search Report for International Application No. PCT/US01/03121 mailed on May 21, 2001 (6 pages).

"Prints From New Epson Ink Jets Offer Longevity of Silver Halide." *The Hard Copy Observer*. vol. X, No. 2, Feb. 2000, pp. 1, 60–64.

* cited by examiner

*Primary Examiner*—Anh T. N. Vo
(74) *Attorney, Agent, or Firm*—Kevin B. Sullivan

(57) ABSTRACT

A replaceable ink container for providing ink to an inkjet printing system. The replaceable ink container includes engagement features disposed on a leading edge and configured for engagement with corresponding engagement features associated with the inkjet printing system. The engagement features define a pivot axis about which the replaceable ink container pivots during an insertion into the inkjet printing system. Also included with the replaceable ink container is a plurality of electrical contacts disposed on the leading edge relative to an insertion direction. The plurality of electrical contacts are disposed on the replaceable ink container below the pivot axis so that pivoting the replaceable ink container about the pivot axis during the insertion causes the plurality of electrical contacts on the ink container to move toward corresponding electrical contacts associated with the printing system to establish an electrical interconnection therebetween.

25 Claims, 13 Drawing Sheets

INK CONTAINER CONFIGURED TO ESTABLISH RELIABLE ELECTRICAL CONNECTION WITH A RECEIVING STATION

BACKGROUND OF THE INVENTION

The present invention relates to ink containers for providing ink to inkjet printers. More specifically, the present invention relates to an ink container that is configured for insertion into a receiving station within an inkjet printing system to establish reliable electrical connection therewith.

Inkjet printers frequently make use of an inkjet printhead mounted within a carriage that is moved relative to a print media, such as paper. As the printhead is moved relative to the print media, a control system activates the printhead to deposit or eject ink droplets onto the print media to form images and text. Ink is provided to the printhead by a supply of ink that is either integral with the printhead, as in the case of a disposable print cartridge, or by a supply of ink that is replaceable separate from the printhead.

One type of previously used printing system makes use of the ink supply that is carried with the carriage. This ink supply has been formed integral with the printhead, whereupon the entire printhead and ink supply are replaced when ink is exhausted. Alternatively, the ink supply can be carried with the carriage and be separately replaceable from the printhead. For the case where the ink supply is separately replaceable, the ink supply is replaced when exhausted. The printhead is then replaced at the end of printhead life. Regardless of where the ink supply is located within the printing system, it is critical that the ink supply provide a reliable supply of ink to the inkjet printhead.

There is an ever present need for inkjet printing systems that make use of replaceable ink containers that are easy to install and remove. The installation of the ink container should produce reliable functional connection to the printer. These ink containers should be relatively easy to manufacture, thereby tending to reduce the ink supply cost. Reduction of the ink supply cost tends to reduce the per page printing cost of the printing system.

SUMMARY OF THE INVENTION

One aspect of the present invention is a replaceable ink container for providing ink to an inkjet printing system. The replaceable ink container includes an engagement feature disposed on the leading edge and configured for engagement with corresponding engagement features associated with the inkjet printing system. The engagement features define a pivot axis about which the replaceable ink container pivots during insertion into the inkjet printing system. Also included with the replaceable ink container is a plurality of electrical contacts disposed on a leading edge relative to an insertion direction. The plurality of electrical contacts are disposed on the replaceable ink container below the pivot axis so that pivoting the replaceable ink container about the pivot axis during insertion causes the plurality of electrical contacts on the ink container to move toward corresponding electrical contacts associated with the printing system to establish electrical interconnection therebetween.

DETAILED DESCRIPTION OF THE PREFERRED EMBODIMENT

Figure 1:
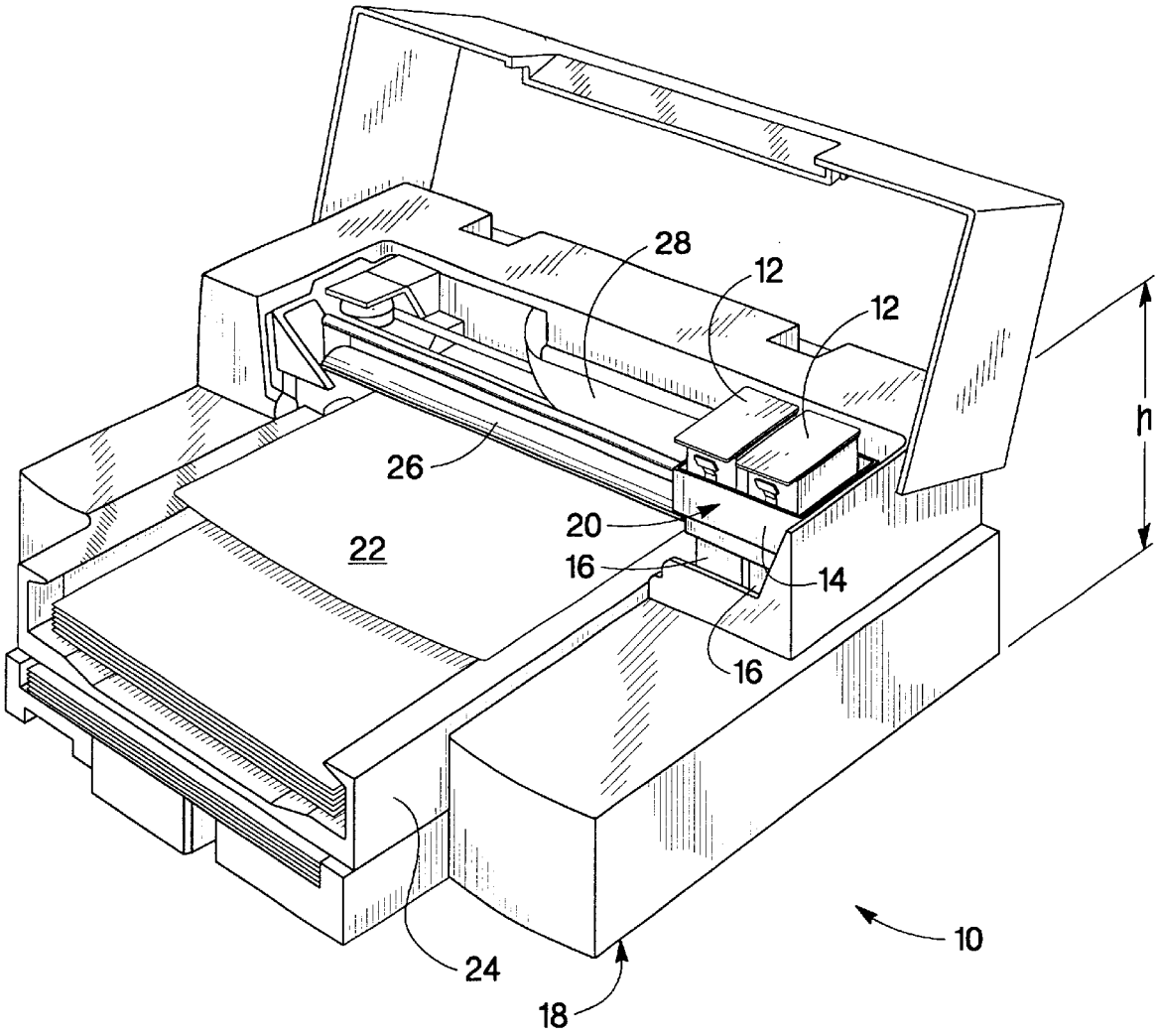
FIG. 1 is one exemplary embodiment of an ink jet printing system of the present invention shown with a cover opened to show a plurality of replaceable ink containers of the present invention.

FIG. 1 is a perspective view of one exemplary embodiment of a printing system 10 shown with its cover open, that includes at least one replaceable ink container 12 that is installed in a receiving station 14. With the replaceable ink container 12 properly installed into the receiving portion 14, ink is provided from the replaceable ink container 12 to at least one inkjet printhead 16. The inkjet printhead 16 is responsive to activation signals from a printer portion 18 to deposit ink on print media. As ink is ejected from the printhead 16, the printhead 16 is replenished with ink from the ink container 12. In one preferred embodiment the replaceable ink container 12, receiving station 14, and inkjet printhead 16 are each part of a scanning carriage that is moved relative to a print media 22 to accomplish printing. The printer portion 18 includes a media tray 24 for receiving the print media 22. As the print media 22 is stepped through a print zone, the scanning carriage 20 moves the printhead 16 relative to the print media 22. The printer portion 18 selectively activates the printhead 16 to deposit ink on print media 22 to thereby accomplish printing.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 16 by means of an electrical link such as a ribbon cable 28.

An important aspect of the present invention is the method and apparatus for inserting the ink container 12 into the receiving station 14 such that the ink container 12 forms proper fluidic and electrical interconnect with the printer portion 18. It is essential that both proper fluidic and electrical connection be established between the ink container 12 and the printer portion 18. The fluidic interconnection allows a supply of ink within the replaceable ink container 12 to be fluidically coupled to the printhead 16 for providing a source of ink to the printhead 16. The electrical interconnection allows information to be passed between the replaceable ink container 12 and the printer portion 1 8. Information passed between the replaceable ink container 12 and the printer portion 18 can include information related to the compatibility of replaceable ink container 12 with printer portion 18 and operation status information such as the ink level information, to name some examples.

The method and apparatus of the present invention, as will be discussed with respect to FIGS. 2 through 14 depict those features which allow the replaceable ink container 12 to be inserted into the receiving station 14 in such a manner that reliable electrical and fluidic connection is established between the replaceable ink container 12 and the receiving station 14. In addition, the method and apparatus of the present invention allows for the insertion and removal of the replaceable printing component 12 from the printer portion 18 in a reliable fashion while allowing the overall height of the printer portion 18, represented by dimension designated as "h" in FIG. 1 to be a relatively small dimension, thereby providing a relatively low profile printing system 10. It is important that the printing system 10 have a low profile to provide a more compact printing system as well as to allow the printer portion to be used in a variety of printing applications.

Figure 2:
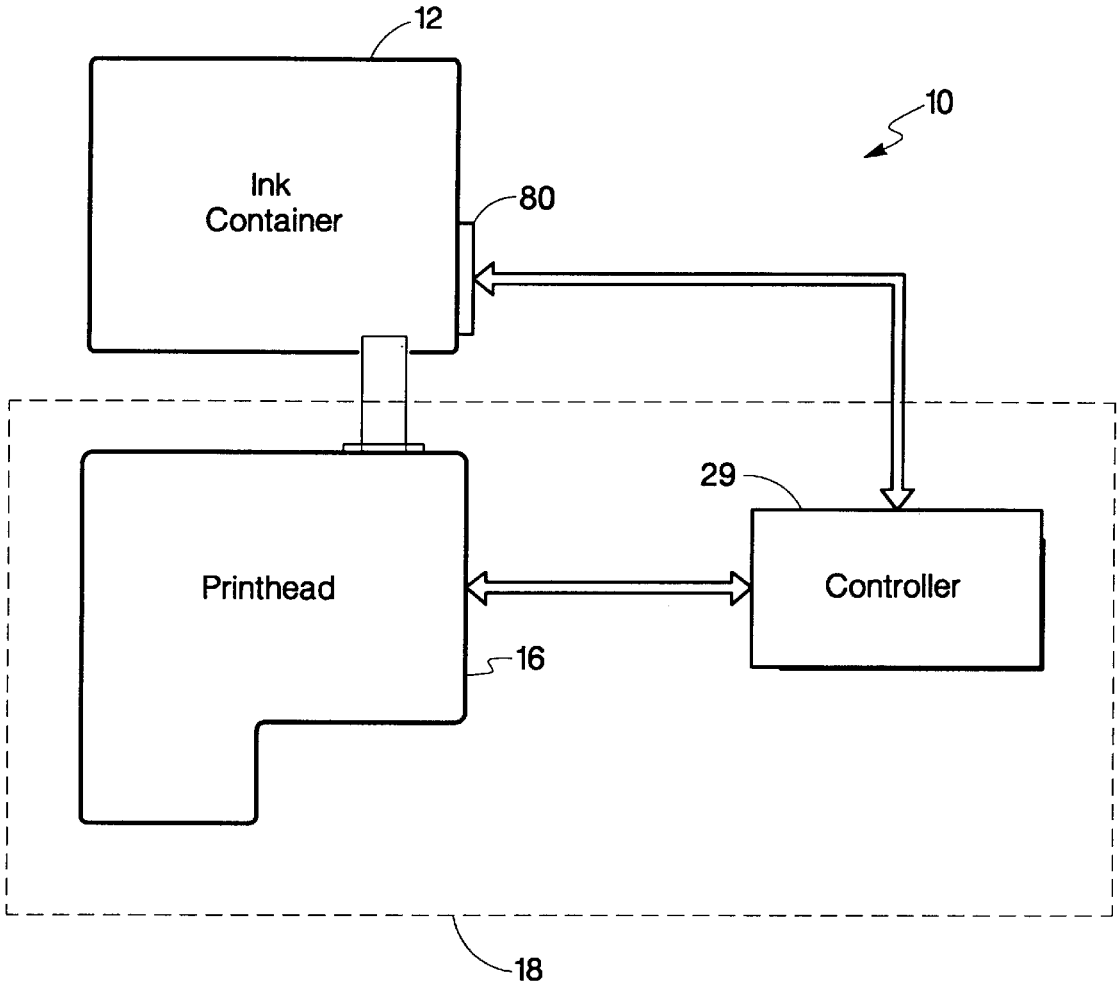
FIG. 2 is a schematic representation of the inkjet printing system shown in FIG. 1.

FIG. 2 is a simplified schematic representation of the inkjet printing system 10 of the present invention shown in FIG. 1. FIG. 2 is simplified to illustrate a single printhead 16 connected to a single ink container 12.

The inkjet printing system 10 of the present invention includes the printer portion 18 and the ink container 12, which is configured to be received by the printer portion 18. The printer portion 18 includes the inkjet printhead 16 and a controller 29.

With the ink container 12 properly inserted into the printer portion 18, an electrical and fluidic coupling is established between the ink container 12 and the printer portion 18. The fluidic coupling allows ink stored within the ink container 12 to be provided to the printhead 16. The electrical coupling allows information to be passed between an electrical storage device 80 disposed on the ink container 12 and the printer portion 18. The exchange of information between the ink container 12 and the printer portion 18 is to ensure the operation of the printer portion 18 is compatible with the ink contained within the replaceable ink container 12 thereby achieving high print quality and reliable operation of the printing system 10.

The controller 29, among other things, controls the transfer of information between the printer portion 18 and the replaceable ink container 12. In addition, the controller 29 controls the transfer of information between the printhead 16 and the controller 29 for activating the printhead to selectively deposit ink on print media. In addition, the controller 29 controls the relative movement of the printhead 16 and print media. The controller 29 performs additional functions such as controlling the transfer of information between the printing system 10 and a host device such as a host computer (not shown).

In order to ensure the printing system 10 provides high quality images on print media, it is necessary that the operation of the controller 29 account for the particular replaceable ink container 12 installed within the printer portion 18. The controller 29 utilizes the parameters that are provided by the electrical storage device 80 to account for the particular replaceable ink container 12 installed in the printer portion 18 to ensure reliable operation and high quality print images.

Among the parameters, for example, that can be stored in the electrical storage device 80 associated with the replaceable ink container 12 can include the following: a date code associated with the replaceable ink container 12, a date code of initial insertion of the ink container 12, system coefficients, ink type and ink color, ink container size, printer model number or identification number and cartridge usage information, just to name a few.

Figure 3:
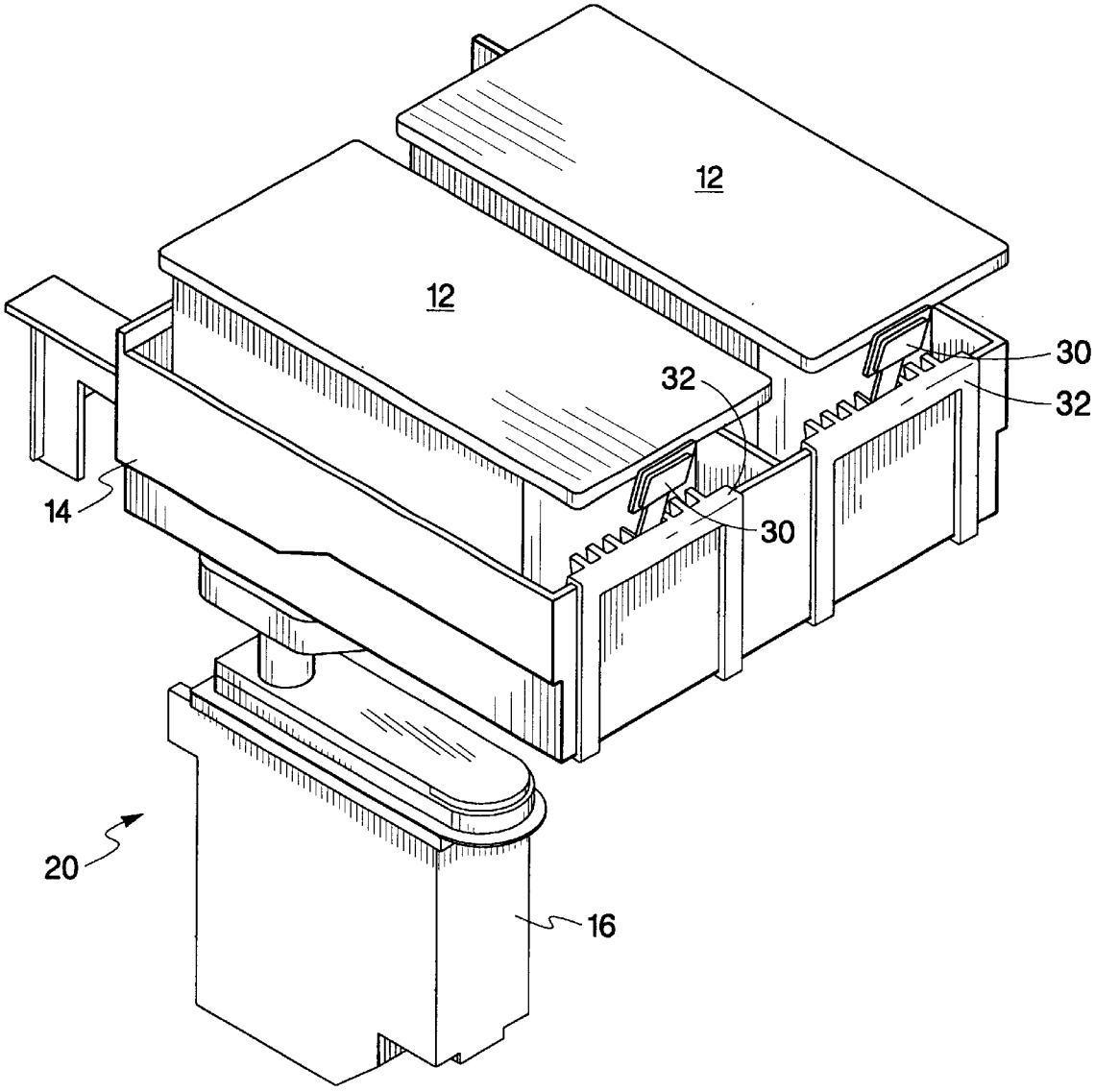
FIG. 3 is a greatly enlarged perspective view of a portion of a scanning carriage showing the replaceable ink containers of the present invention positioned in a receiving station that provides fluid communication between the replaceable ink containers and one or more printheads.

FIG. 3 is a perspective view of a portion of the scanning carriage 20 showing a pair of replaceable ink containers 12 properly installed in the receiving station 14. An inkjet printhead 16 is in fluid communication with the receiving station 14. In the preferred embodiment, the inkjet printing system 10 shown in FIG. 1 includes a tricolor ink container containing three separate ink colors and a second ink container containing a single ink color. In this preferred embodiment, the tricolor ink container contains cyan, magenta, and yellow inks, and the single color ink container contains black ink for accomplishing four-color printing. The replaceable ink containers 12 can be partitioned differently to contain fewer than three ink colors or more than three ink colors if more are required. For example, in the case of high fidelity printing, frequently six or more colors are used to accomplish printing.

The scanning carriage portion 20 shown in FIG. 3 is shown fluidically coupled to a single printhead 16 for simplicity. In the preferred embodiment, four inkjet printheads 16 are each fluidically coupled to the receiving station 14. In this preferred embodiment, each of the four printheads are fluidically coupled to each of the four colored inks contained in the replaceable ink containers. Thus, the cyan, magenta, yellow and black printheads 16 are each coupled to their corresponding cyan, magenta, yellow and black ink supplies, respectively. Other configurations which make use of fewer printheads than four are also possible. For example, the printhead 16 can be configured to print more than one ink color by properly partitioning the printhead 16 to allow a first ink color to be provided to a first group of ink nozzles and a second ink color to be provided to a second group of ink nozzles, with the second group of ink nozzles different from the first group. In this manner, a single printhead 16 can be used to print more than one ink color allowing fewer than four printheads 16 to accomplish four-color printing. The fluidic path between each of the replaceable ink containers 12 and the printhead 16 will be discussed in more detail with respect to FIG. 4.

Each of the replaceable ink containers 12 include a latch 30 for securing the replaceable ink container 12 to the receiving station 14. The receiving station 14 in the preferred embodiment includes a set of keys 32 that interact with corresponding keying features (not shown) on the replaceable ink container 12. The keying features on the replaceable ink container 12 interact with the keys 32 on the receiving station 14 to ensure that the replaceable ink container 12 is compatible with the receiving station 14.

Figure 4:
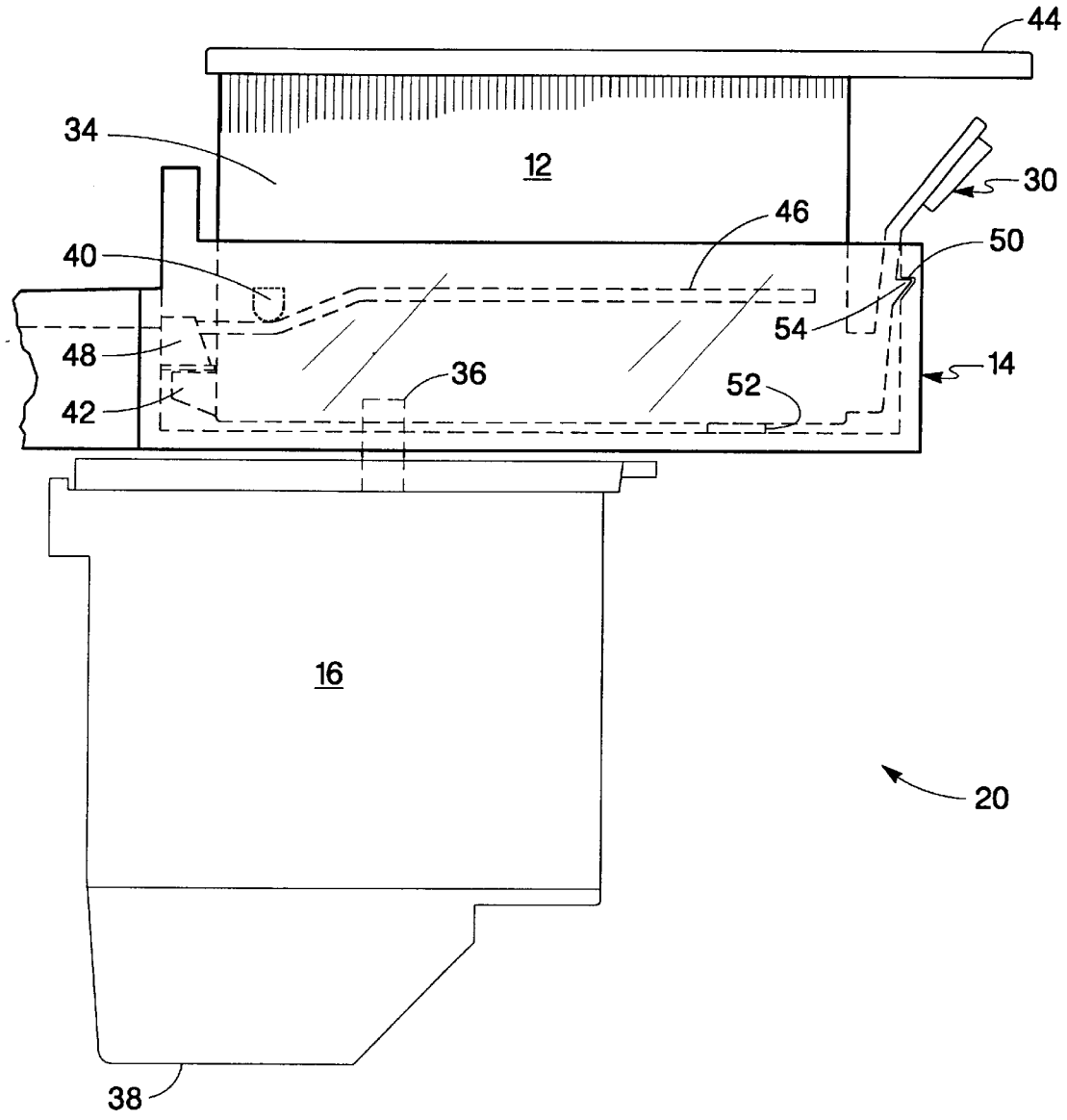
FIG. 4 is a side plan view of a portion of the scanning carriage showing guiding and latching features associated with each of the replaceable ink container and the receiving station for securing the replaceable ink container, thereby allowing fluid communication with the printhead.

FIG. 4 is a side plan view of the scanning carriage portion 20 shown in FIG. 2. The scanning carriage portion 20 includes the ink container 12 shown properly installed into the receiving station 14, thereby establishing fluid communication between the replaceable ink container 12 and the printhead 16.

The replaceable ink container 12 includes a reservoir portion 34 for containing one or more quantities of ink. In the preferred embodiment, the tri-color replaceable ink container 12 has three separate ink containment reservoirs, each containing ink of a different color. In this preferred embodiment, the monochrome replaceable ink container 12 is a single ink reservoir 34 for containing ink of a single color.

In the preferred embodiment, the reservoir 34 has a capillary storage member (not shown) disposed therein. The capillary storage member is a porous member having sufficient capillarity to retain ink to prevent ink leakage from the reservoir 34 during insertion and removal of the ink container 12 from the printing system 10. This capillary force must be sufficiently great to prevent ink leakage from the ink reservoir 34 over a wide variety of environmental conditions such as temperature and pressure changes. In addition, the capillarity of the capillary member is sufficient to retain ink within the ink reservoir 34 for all orientations of the ink reservoir as well as a reasonable amount of shock and vibration the ink container may experience during normal handling. The preferred capillary storage member is a network of heat bonded polymer fibers described in US Patent Application entitled "Ink Reservoir for an Inkjet Printer" attorney docket 10991407 filed on Oct. 29, 1999, Ser. No. 09/430,400, assigned to the assignee of the present invention and incorporated herein by reference.

Once the ink container 12 is properly installed into the receiving station 14, the ink container 12 is fluidically coupled to the printhead 16 by way of fluid interconnect 36. Upon activation of the printhead 16, ink is ejected from the ejection portion 38 producing a negative gauge pressure, sometimes referred to as backpressure, within the printhead 16. This negative gauge pressure within the printhead 16 is sufficient to overcome the capillary force resulting from the capillary member disposed within the ink reservoir 34. Ink is drawn by this backpressure from the replaceable ink container 12 to the printhead 16. In this manner, the printhead 16 is replenished with ink provided by the replaceable ink container 12.

The fluid interconnect 36 is preferably an upstanding ink pipe that extends upwardly into the ink container 12 and downwardly to the inkjet printhead 16. The fluid interconnect 36 is shown greatly simplified in FIG. 4. In the preferred embodiment, the fluid interconnect 36 is a manifold that allows for offset in the positioning of the printheads 16 along the scan axis, thereby allowing the printhead 16 to be placed offset from the corresponding replaceable ink container 12. In the preferred embodiment, the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. As will be discussed, it is crucial that the ink container 12 be properly positioned within the receiving station 14 such that proper compression of the capillary member is accomplished when the ink container 12 is inserted into the receiving station. Proper compression of the capillary member is necessary to establish a reliable flow of ink from the ink container 12 to the printhead 16.

The replaceable ink container 12 further includes a guide feature 40, an engagement feature 42, a handle 44 and a latch feature 30 that allow the ink container 12 to be inserted into the receiving station 14 to achieve reliable fluid interconnection with the printhead 16 as well as form reliable electrical interconnection between the replaceable ink container 12 and the scanning carriage 20 as will be discussed with respect to FIGS. 9*a* through 9*c* and 10*a* through 10*b*.

The receiving station 14 includes a guide rail 46, an engagement feature 48 and a latch engagement feature 50. The guide rail 46 cooperates with the guide rail engagement feature 40 and the replaceable ink container 12 to guide the ink container 12 into the receiving station 14. Once the replaceable ink container 12 is fully inserted into the receiving station 14, the engagement feature 42 associated with the replaceable ink container engages the engagement feature 48 associated with the receiving station 14, securing a front end or a leading end of the replaceable ink container 12 to the receiving station 14. The ink container 12 is then pressed downward to compress a spring biasing member 52 associated with the receiving station 14 until a latch engagement feature 50 associated with the receiving station 14 engages a hook feature 54 associated with the latch member 30 to secure a back end or tailing end of the ink container 12 to the receiving station 14. It is the cooperation of the features on the ink container 12 with the features associated with the receiving station 14 that allow proper insertion and functional interfacing between the replaceable ink container 12 and the receiving station 14. The receiving station 14 will now be discussed in more detail with respect to FIG. 5.

Figure 5:
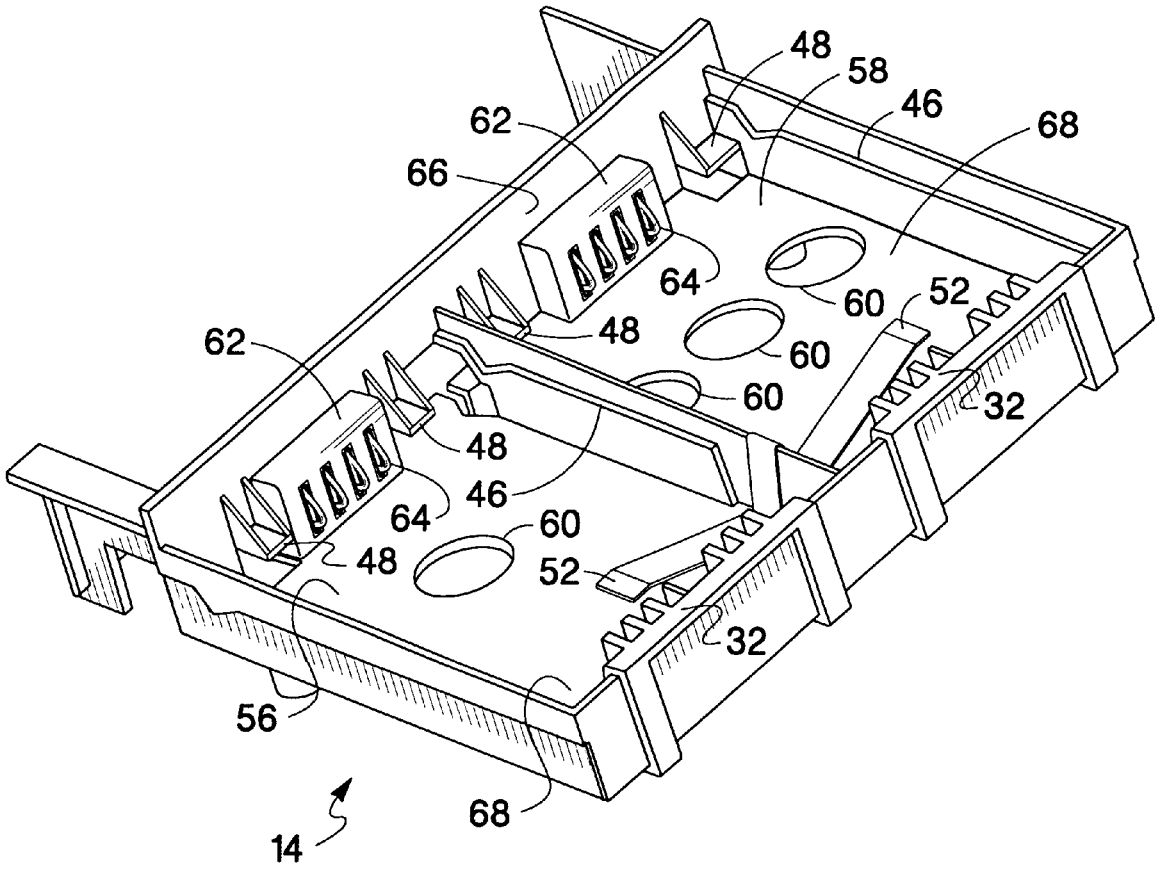
FIG. 5 is a receiving station shown in isolation for receiving one or more replaceable ink containers of the present invention.

FIG. 5 is a front perspective view of the ink receiving station 14 shown in isolation. The receiving station 14 shown in FIG. 5 includes a monochrome bay 56 for receiving an ink container 12 containing a single ink color and a tri-color bay 58 for receiving an ink container having three separate ink colors contained therein. In this preferred embodiment, the monochrome bay 56 receives a replaceable ink container 12 containing black ink, and the tri-color bay receives a replaceable ink container containing cyan, magenta, and yellow inks, each partitioned into a separate reservoir within the ink container 12. The receiving station 14 as well as the replaceable ink container 12 can have other arrangements of bays 56 and 58 for receiving ink containers containing different numbers of distinct inks contained therein. In addition, the number of receiving bays 56 and 58 for the receiving station 14 can be fewer or greater than two. For example, a receiving station 14 can have four separate bays for receiving four separate monochrome ink containers 12 with each ink container containing a separate ink color to accomplish four-color printing.

Each bay 56 and 58 of the receiving station 14 includes an aperture 60 for receiving each of the upright fluid interconnects 36 that extends therethrough. The fluid interconnect 36 is a fluid inlet for ink to exit a corresponding fluid outlet associated with the ink container 12. An electrical interconnect 62 is also included in each receiving bay 56 and 58. The electrical interconnect 62 includes a plurality of electrical contacts 64. In the preferred embodiment, the electrical contacts 64 are an arrangement of four spring-loaded electrical contacts with proper installation of the replaceable ink container 12 into the corresponding bay of the receiving station 14. Proper engagement with each of the electrical connectors 62 and fluid interconnects 36 must be established in a reliable manner.

The guide rails 46 disposed on either side of the fluid interconnects within each bay 56 and 58 engage the corresponding guide feature 40 on either side of the ink container 12 to guide the ink container into the receiving station. When the ink container 12 is fully inserted into the receiving station 14, the engagement features 48 disposed on a back wall 66 of the receiving station 14 engage the corresponding engagement features 42 shown in FIG. 3 on the ink container 12. The engagement features 48 are disposed on either side of the electrical interconnect 62. A biasing means 52 such as a leaf spring is disposed within the receiving station 14. The leaf spring 52 provides a biasing force that tends to urge the ink container 12 upward from a bottom surface 68 of the receiving station 14. The leaf spring aids in the latching of the ink container 12 to the receiving station 14 as well as aiding the removal of the ink container 12 from the receiving station as will be discussed with respect to FIGS. 10 and 11. FIGS. 6*a*, 6*b*, 6*c*, and 6*d* show front plan, side plan, back plan, and bottom plan views, respectively, of the replaceable ink container 12 of the present invention. As shown in FIG. 6*a*, the replaceable ink container 12 includes a pair of outwardly projecting guide rail engagement features 40. In the preferred embodiment, each of these guide rail engagement features 40 extend outwardly in a direction orthogonal to upright side 70 of the replaceable ink container 12. The engagement features 42 extend outwardly from a front surface or leading edge 72 of the ink container 12. The engagement features 42 are disposed on either side of an electrical interface 74 and are disposed toward a bottom surface 76 of the replaceable ink container 12. The electrical interface 74 includes a plurality of electrical contacts 78, with each of the electrical contacts 78 electrically connected to an electrical storage device 80.

Figure 6C:
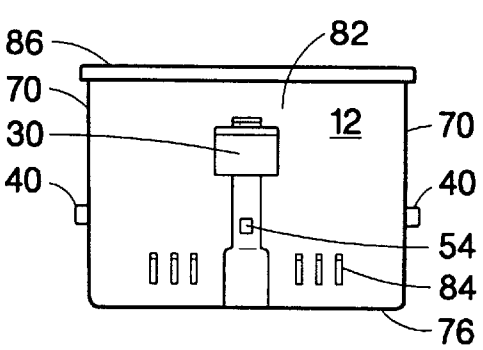
FIGS. 6*a*, 6*b*, 6*c*, and 6*d* are isometric views of a three-color replaceable ink container of the present invention shown in isolation.
Figure 6B:
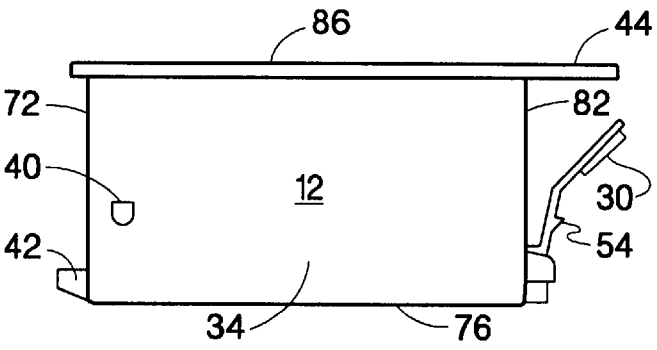
Figure 6A:
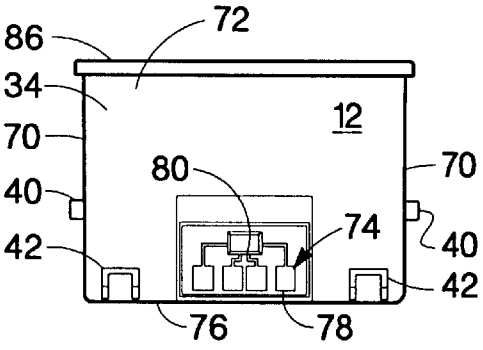
Figure 6D:
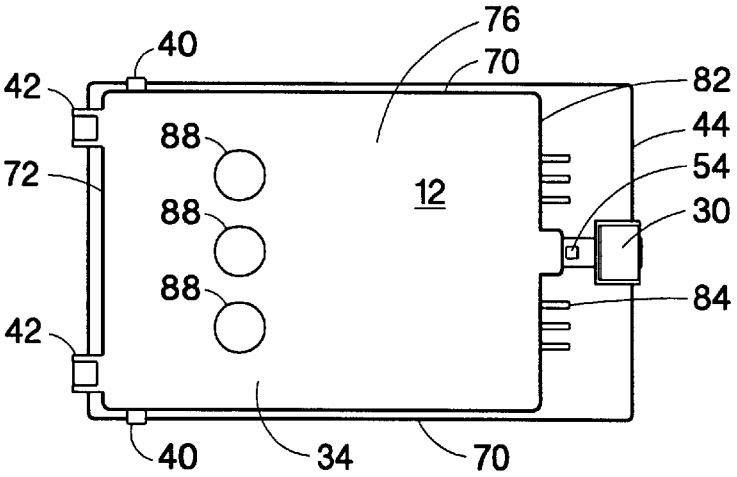

Opposite the leading end 72 is a trailing end 82 shown in FIG. 6*c*. The trailing end 82 of the replaceable ink container 12 includes the latch feature 30 having an engagement hook 54. The latch feature 30 is formed of a resilient material which allows the latch feature to extend outwardly from the trailing end thereby extending the engagement feature outwardly toward the corresponding engagement feature associated with the receiving station 14. As the latch member 30 is compressed inwardly toward the trailing end 82, the latch member exerts a biasing force outwardly in order to ensure the engagement feature 54 remains in engagement with the corresponding engagement feature 50 associated with the receiving station 14 to secure the ink container 12 into the receiving station 14.

The replaceable ink container 12 also includes keys 84 disposed on the trailing end of the replaceable ink container 12. The keys are preferably disposed on either side of the latch 30 toward the bottom surface 76 of the replaceable ink container 12. The keys 84, together with keying features 32 on the receiving station 14, interact to ensure the ink container 12 is inserted in the correct bay 56 and 58 in the receiving station 14. In addition, the keys 84 and the keying features 32 ensure that the replaceable ink container 12 contains ink that is compatible both in color and in chemistry or compatibility with the corresponding receiving bay 56 and 58 within the receiving station 14.

The handle portion 44 disposed on a top surface 86 at the trailing edge 82 of the replaceable ink container 12. The handle portion 44 allows the ink container 12 to be grasped at the trailing edge 82 while inserted into the appropriate bay of the receiving station 14. Positioning the handle portion above apertures 88 tends to reduce the opportunity for the customer to get ink on their hands while inserting the ink container 12 into the receiving station 14. In addition, the handle portion 44 is disposed on the reservoir 34 opposite the electrical contacts 78 to reduce or eliminate handling of the electrical contacts 78 during insertion of the ink container 12 into the receiving station 14. This handling by a human hand can contaminate the electrical contacts. Contamination of the electrical contact with salts and oils frequently found in human skin can result in an unreliable or high resistance electrical connection between the ink container 12 and the printer portion 18.

The ink container 12 includes apertures 88 disposed on the bottom surface 76 of the replaceable ink container 12. The apertures 88 allow the fluid interconnect 36 to extend through the reservoir 34 to engage the capillary member disposed therein. In the case of the tri-color replaceable ink container 12, there are three fluid outlets 88, with each fluid outlet corresponding to a different ink color. In the case of the tricolor chamber, each of three fluid interconnects 36 extend into each of the fluid outlets 88 to provide fluid communication between each ink chamber and the corresponding print head for that ink color.

Figure 7:
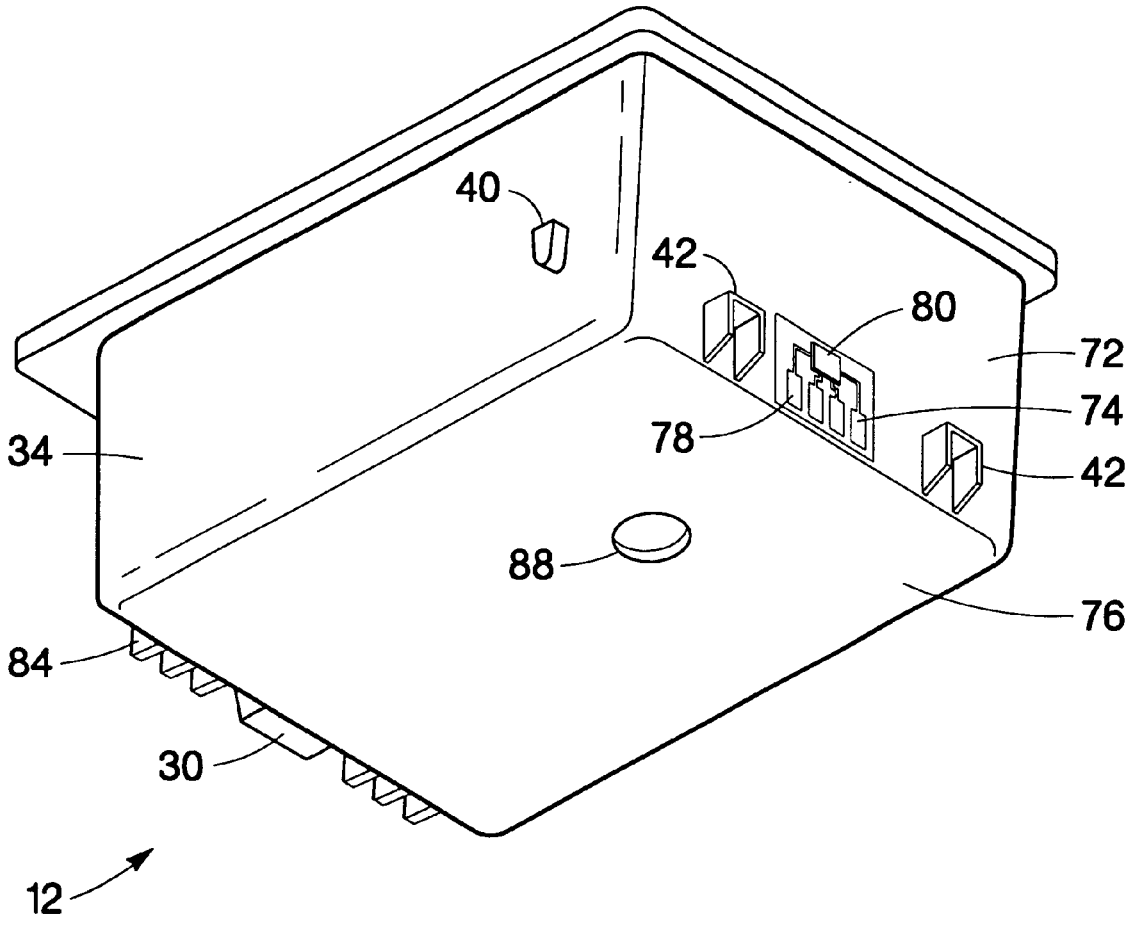
FIG. 7 is a perspective view of a single color replaceable ink container of the present invention.

FIG. 7 is a perspective view of a monochrome ink container positioned for insertion into the monochrome bay 56 in the receiving station 14 shown in FIG. 5. The monochrome ink container shown in FIG. 7 is similar to the tri-color ink container shown in FIGS. 6*a* through 6*d* except that only a single fluid outlet 88 is provided in the bottom surface 76. The monochrome replaceable ink container 12 contains a single ink color and therefore receives only a single corresponding fluid interconnect 36 for providing ink from the ink container 12 to the corresponding printhead.

Figure 8:
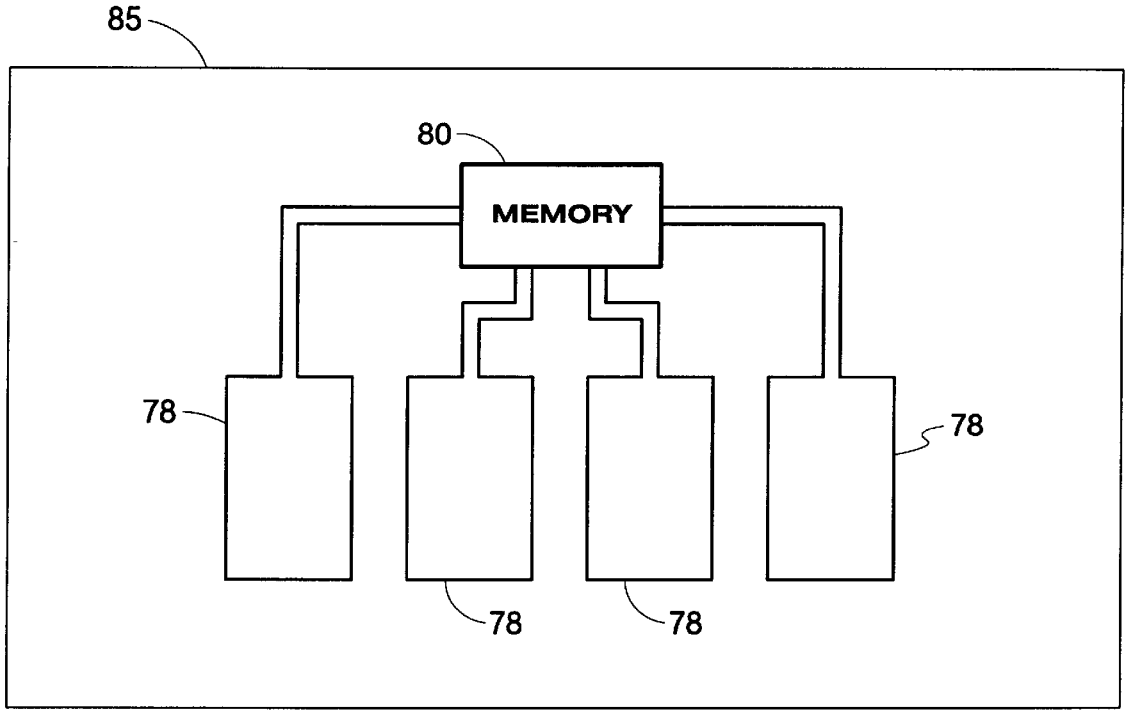
FIG. 8 is a top plan view of an electrical storage device that is electrically connected to a plurality of electrical contacts.

FIG. 8 is a greatly enlarged view of the electrical storage device 80 and electrical contacts 78. In one preferred embodiment, the electrical storage device 80 and the electrical contacts are mounted on a substrate 85. Each of the electrical contacts 78 is electrically connected to the electrical storage device 80. Each of the electrical contacts 78 is electrically isolated from each other by the substrate 85. In one preferred embodiment, the electrical storage device 80 is a semiconductor memory that is mounted to the substrate 85. In the preferred embodiment, the substrate 85 is adhesively bonded to the ink container 12.

In one preferred embodiment, there are four electrical contacts 78 representing contacts for power and ground connections as well as clock and data connections. Insertion of the replaceable ink container 12 into the printing portion 18 establishes electrical connection between the electrical contacts 64 on the receiving station 14 and the electrical contacts 78 on the replaceable ink container 12. With power and ground applied to the electrical storage device 80, data is transferred between the printing portion 18 and the replaceable ink container 12 at a rate established by the clock signal. It is critical that electrical connection between the printer portion 18 and the replaceable ink container 12 formed by electrical contacts 64 and 78, respectively, be low resistance connections to ensure reliable data transfer. If the electrical contacts 64 and 78 fail to provide a low resistance connection, then data may not be properly transferred, or the data may be corrupted or inaccurate. Therefore, it is critical that reliable, low resistance connection is made between the ink container 12 and the printing portion 18 to ensure proper operation of the printing system 10. One aspect of the present invention to establish reliable electrical connection between the ink container 12 and the printing portion 18 is discussed in more detail in FIGS. 10, 11*a* and 11*b*.

Figure 9A:
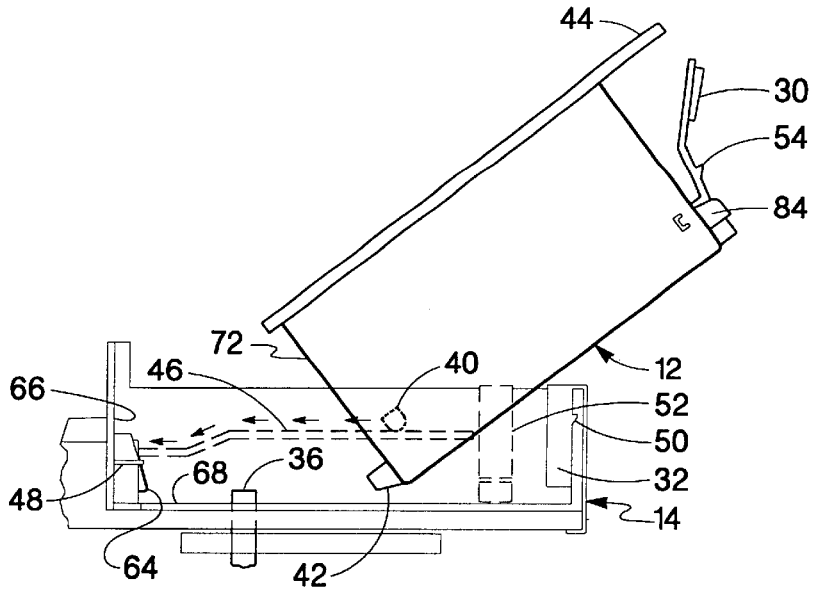
FIG. 9*a*, 9*b*, and 9*c* depict the method of the present invention for inserting the replaceable ink container into the supply station.
Figure 9B:
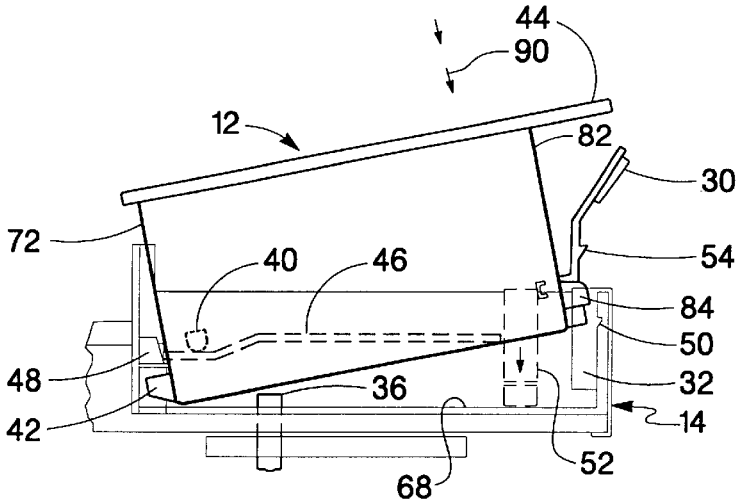
Figure 9C:
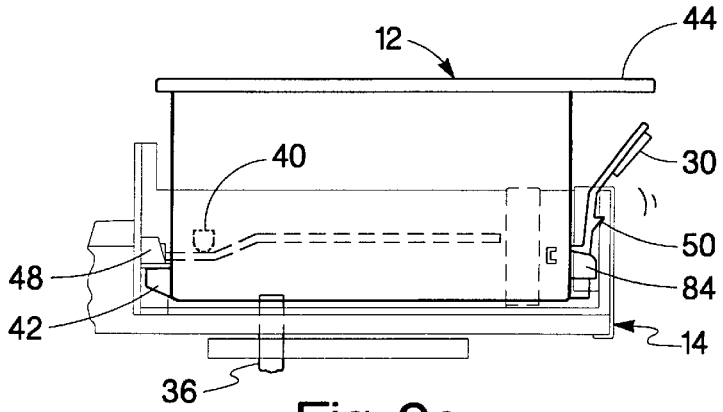

FIG. 9*a*, 9*b*, and 9*c* is a sequence of figures to illustrate the technique of the present invention for inserting the replaceable ink container 12 into the receiving station 14 to form reliable electrical and fluidic connections with the receiving station 14.

FIG. 9*a* shows the ink container 12 partially inserted into the receiving station 14. In the preferred embodiment, the ink container 12 is inserted into the receiving station 14 by grasping the handle portion 44 and inserting the ink container into the receiving station 14 with the leading edge or leading face 72 first. As the leading edge 72 enters the receiving station 14 the outwardly extending guide members 40 on the ink container engage each of the pair of guide rails 46. The guide rails 46 guide the ink container 12 in a horizontal or linear motion toward the back wall 66 of the receiving station 14. The guide rails 46 then guide the replaceable ink container in both a horizontal direction toward the back wall 66 and a vertical direction toward the bottom surface of the receiving station 14 such that the engagement feature 42 on the ink container 12 is received by a corresponding engagement feature 48 on the back wall 66 of the receiving station 14 as shown in FIG. 9*b*. The insertion of the ink container 12 requires only an insertion force to urge the ink container linearly along the guide rail 46. The gravitational force acting on the ink container 12 tends to cause the ink container to follow the guide rails 46 as the guide rails extend in a downward direction to allow engagement of engagement features 42 and 48. The guide rail engagement features 40 are preferably gently rounded surfaces to slide freely along the guide rails 46.

FIG. 9*b* shows the ink container 12 inserted into the receiving station 14 such that the engagement feature 42 is in engagement with the engagement feature 48 associated with the receiving station 14. A downward force is applied to the ink container 12 as represented by arrows 90 to compress the leaf spring 52 and to urge the trailing end 82 of the ink container 12 downwardly toward the bottom surface 68 of the receiving station 14. The keys 84 must properly correspond to the keying feature 32 on the receiving station 14. If the keys 84 on the ink container 12 do not correspond to the keying features 32, the keying system will prevent further insertion of the ink container 12 into the receiving station 14. This keying system made up of keys 84 and the keying features 32 prevent ink containers that are not compatible with the receiving station 14 from further insertion into the receiving station 14. Further insertion of the ink container 12 into the receiving station 14 could result in contact of the fluid interconnect 36 with the capillary member within the ink container 12, thereby contaminating the fluid interconnect 36 with incompatible ink. Incompatible ink mixing in the fluid interconnect 36 can result in precipitation which can damage the printhead 16. In addition to inks of incompatible chemistries, the ink container can have an incompatible color which can result in color mixing, thereby reducing the output print quality.

The keys 84 on the ink container 12 and the keying features 32 on the receiving station 14 allow for the complete insertion of the proper ink container 12 into the proper receiving station 14. The downward force applied to the trailing end 82 of the ink container 12 causes the ink container 12 to pivot about a pivot axis compressing the leaf spring 52, thereby moving the trailing edge 82 of the ink container 12 toward the bottom surface 68 of the receiving station 14. As the ink container 12 is urged downward into the receiving station 14, the resilient latch 30 is compressed slightly inward toward the trailing edge 82 of the ink container 12. Once the ink container 12 is urged downward sufficiently far, the engagement feature 54 on the latch 30 engages with a corresponding engagement feature 50 on the receiving station 14 to secure the ink container 12 to the receiving station 14 as shown in FIG. 9*c*.

With the ink container 12 properly secured in the receiving station 14 as shown in FIG. 9*c* the fluid interconnect 36 extends into the reservoir 34 to compress the capillary member, thereby forming a region of increased capillarity adjacent the fluid interconnect 36. This region of increased capillarity tends to draw ink toward the fluid interconnect 36, thereby allowing ink to flow through the fluid interconnect 36 to the printhead 16. In the preferred embodiment, the ink container 12 when inserted into the receiving station 14 is oriented in a gravitational frame of reference so that a gravitational force acts on ink within the ink container 12 tending to draw ink toward the bottom surface 76 of the ink container 12. Thus ink within the ink container 12 is drawn to the bottom surface 76 where this ink is drawn toward the fluid interconnect 36 by capillary attraction thereby tending to reduce or minimize stranding of ink within the ink container 12.

Figure 10:
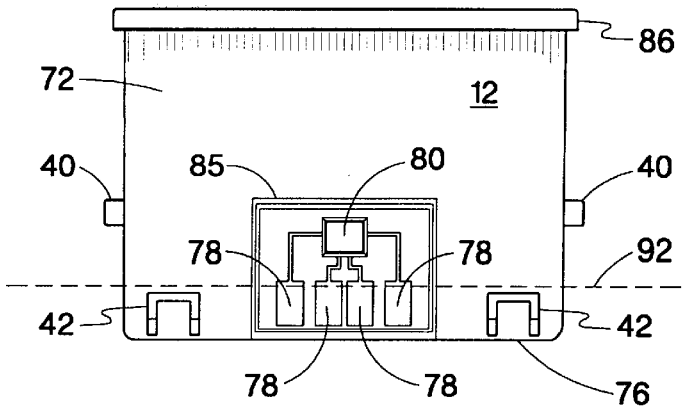
FIG. 10 is a greatly enlarged plan view of a leading edge of the replaceable ink container shown in FIG. 6*a* shown with a pivot axis shown in dashed lines.

FIG. 10 shows a front plan view of the replaceable ink container 12 of the present invention. The front plan view or leading edge 72 of the ink container 12 includes the engagement features 42 disposed toward the bottom surface 76 of the leading edge 72 of the ink container 12. In the preferred embodiment, the engagement feature 42 is a pair of engagement features disposed on opposite sides of the leading edge 72 of the ink container 12. As discussed previously with respect to the insertion sequence for the ink container 12 into the receiving station 14 shown in FIGS. 9*a*, 9*b*, and 9*c*, once partially inserted the ink container 12 is pivoted about a pivot axis 92 to fully insert the ink container 12 into the receiving station 14.

The pivot axis 92 is shown in FIG. 10 and is disposed proximate the engagement features 42. The pivot axis is defined by the engagement features 42 on the ink container 12 which interact with corresponding engagement features 48 disposed on the back wall 66 of the supply station 14. Once the ink container 12 is partially inserted into the receiving station 14 as shown in FIG. 9*b*, the downward force as represented by arrows 90 to fully insert the ink container 12 into the receiving station 14, results in the pivoting of the ink container 12 about the pivot axis 92. The engagement features 42 engage the corresponding engagement features 48 on the receiving station to trap the leading edge 72 of the ink container 12. This trapping of the leading edge 42 prevents upward motion of the leading edge 72 as the downward force 90 is applied to the trailing edge 82 of the ink container 12 producing a pivot motion about the pivot axis 92.

If, for example, the engagement features 42 on the ink container 12 did not properly engage the engagement features 48 on the receiving station 14, then as the downward force 90 were applied at the trailing 82 of the ink container 12, the leading edge 72 of the ink container would rise upward due to the engagement of the fluid interconnect 36 extending into the apertures 88 and engaging the capillary member within the reservoir 34 and urging the leading edge 72 upwards as the trailing edge 82 is urged downward by the downward force 90. Therefore, it is essential that the engagement features 42 properly engage the corresponding engagement features 48 on the receiving station 14 to properly pivot the ink container 12 about the pivot axis 92 during insertion of the ink container 12 into the receiving station 14. It is both the engagement features 42 and their engagement with the corresponding engagement features on the receiving station 14 that defines the pivot axis 92.

The ink container 12 as shown in FIG. 10 also includes a plurality of electrical contacts 78, each of which is electrically connected to the electrical storage device 80 all of which are mounted on the substrate 85. The substrate 85 is in turn disposed on the leading edge 72 of the ink container 12. It is important that the electrical contacts 78 be disposed at least partially between the pivot axis 92 and the bottom surface 76 of the ink container 12. As will be discussed with respect to FIGS. 11*a* and 11*b*, it is the positioning of the electrical contacts 78 below the pivot axis 92 that allows the electrical contacts 78 to move forward during the pivoting of the ink container 12 that allows proper electrical engagement between the ink container 12 and the receiving station 14.

Figure 11A:
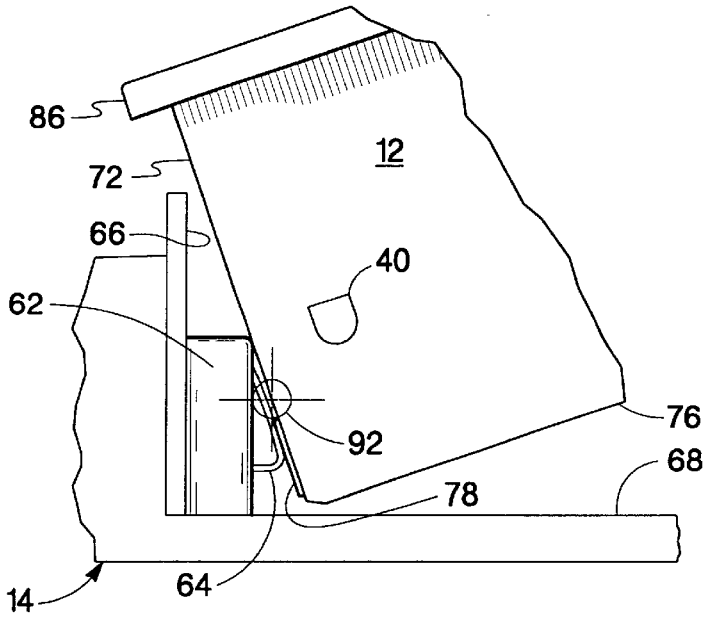
FIG. 11*a* and 11*b* are greatly enlarged representations showing the pivoting of the replaceable ink container about the pivot axis during insertion of the replaceable ink container into the supply station.
Figure 11B:
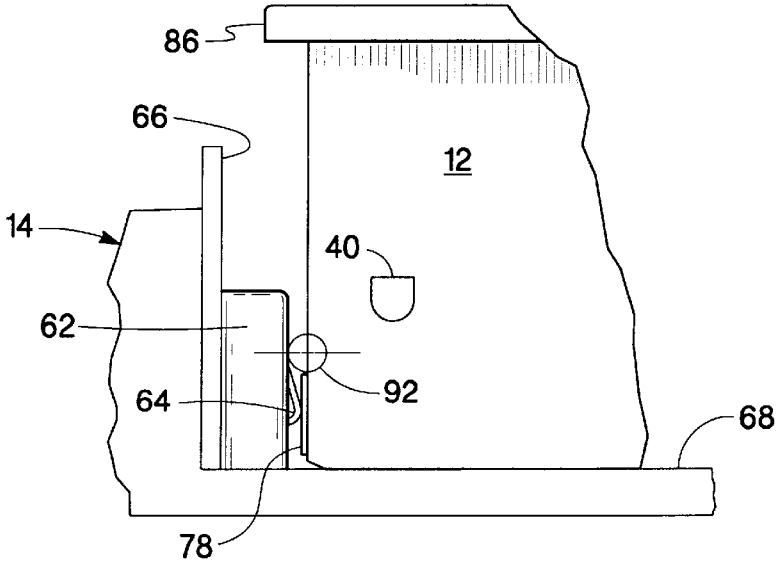

FIGS. 11*a* and 11*b* are simplified representations of the pivoting of the ink container 12 into the receiving station 14 as shown previously in FIGS. 9*b* and 9*c*. FIGS. 11*a* and 11*b* are greatly simplified to better illustrate the positioning of the electrical contacts 78 on the ink container 12 and how this positioning during the pivoting of the ink container 12 about the pivot axis 92 ensures proper engagement of the electrical contacts 78 on the ink container 12 with the electrical contacts 64 on the receiving station 14.

FIG. 11*a* and 11*b* are side plan views of the ink container 12 and receiving station 14 shown greatly enlarged and partially broken away. The pivot axis 92 is represented by a circle having a cross centered thereon. The pivot axis 92 is a point on the ink container about which the ink container 12 pivots during the insertion of the ink container 12 into the receiving station 14. It should be noted that both the engagement features 42 associated with the ink container 12 and the engagement feature 48 associated with the receiving station 14 are not shown to better illustrate the electrical engagement between the ink container 12 and the receiving station 14. FIG. 11*a* represents partial insertion of the ink container 12 into the receiving station 14 as shown previously in FIG. 9*b*. A downward force is then applied to the trailing end of the ink container 12 to pivot the ink container about the pivot axis 92. As the ink container 12 is pivoted about the pivot axis 92, portions on the leading edge 72 above the pivot axis move away from the back wall 66 of the receiving station 14. Conversely, portions of the leading edge 72 below the pivot axis 92, or between the pivot axis 92 and the bottom surface 76 of the ink container 12 move toward the back wall 66 of the receiving station 14. It is the positioning of the electrical contacts 78 below the pivot axis 92 that allows the electrical contacts to be moved in an arc toward the electrical contacts 64 on the electrical connector 62 to achieve electrical contacts between the ink container 12 and the receiving station 14.

FIG. 11*b* shows the ink container 12 fully inserted into the receiving station 14. It can be seen that as the ink container 12 pivots in an arc about the pivot axis 92, the electrical contacts 78 move in an arc toward the electrical contacts 64 associated with the receiving station 14. As the electrical contacts 78 engage the corresponding electrical contacts 64, operational or electrical connection is established between the ink container 12 and the receiving station 14. In the preferred embodiment, the electrical contacts 64 associated with the receiving station 14 are spring-biased and therefore compress or retract slightly as the electrical contacts 78 engage the electrical contacts 64. The use of spring-biased electrical contacts 64 on the receiving station 14 aids in achieving more reliable electrical contact and allows for greater tolerance variation in both the ink container 12 and receiving station 14.

Figure 12:
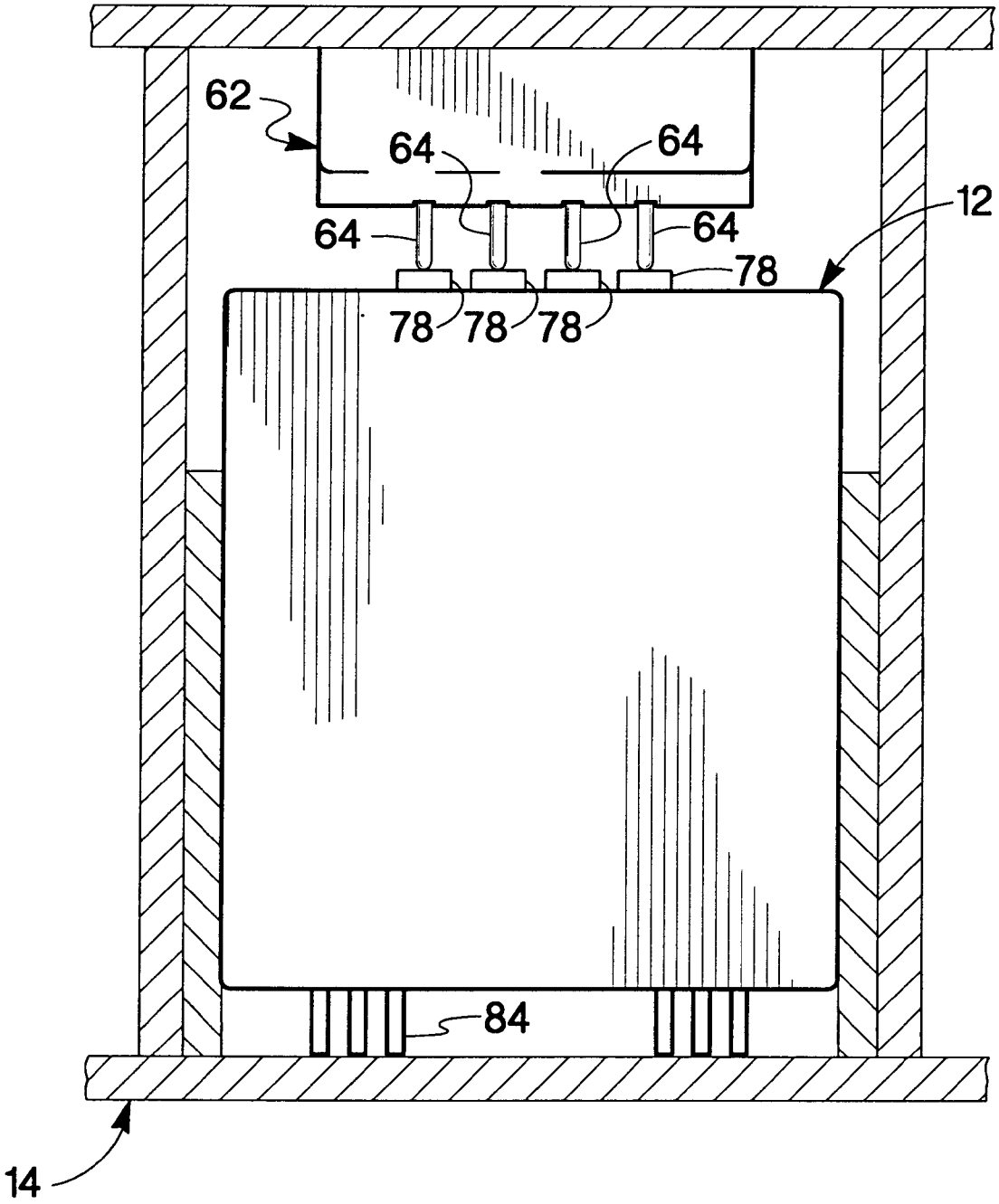
FIG. 12 is a top plan representation of the ink container installed in the supply station to establish electrical connection between the ink container and the supply station.

FIG. 12 is a simplified top plan view of the ink container 12 installed within the receiving station 14. FIG. 12 is intended to illustrate how electrical interconnection between the ink container 12 and receiving station 14 is achieved and is not drawn to scale. In the preferred embodiment, the receiving station 14 includes the electrical interconnect 62 having a plurality of spring-loaded electrical contacts 64.

The ink container 12 includes a plurality of electrical contacts 78 disposed thereon. The ink container 12 is configured such that when inserted into the receiving station 14 each of the plurality of electrical contacts 78 engages each of the plurality of spring-biased electrical contacts 64 on the receiving station 14. The electrical contacts 64 are slightly compressed so that each of the electrical contacts are biased against each of the electrical contacts 78 associated with the ink container such that a reliable electrical interconnection is established between the ink container 12 and the receiving station 14. This electrical interconnection between the ink container 12 and the receiving station 14 allows information to be transferred between the electrical storage device 80 disposed on the ink container 12 and the controller 29 disposed in the printer portion 18 shown in FIG. 2.

Figure 13B:
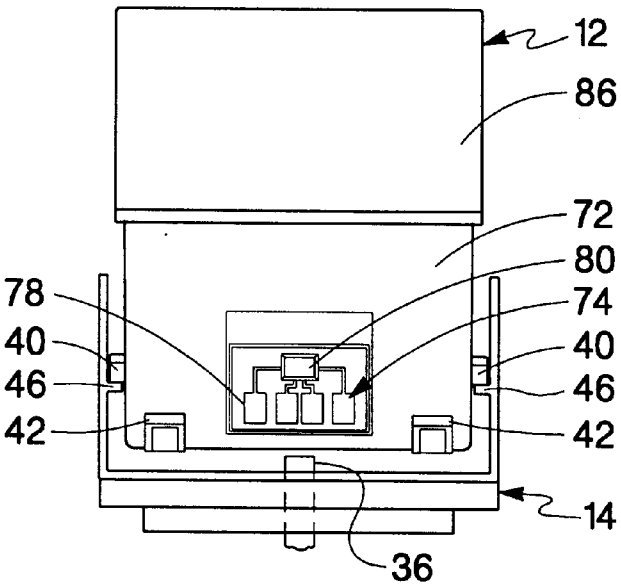
FIG. 13*a* and 13*b* depict the passage of the replaceable ink container over an upstanding fluid inlet on the receiving station viewed from a side view and an end view, respectively.
Figure 13A:
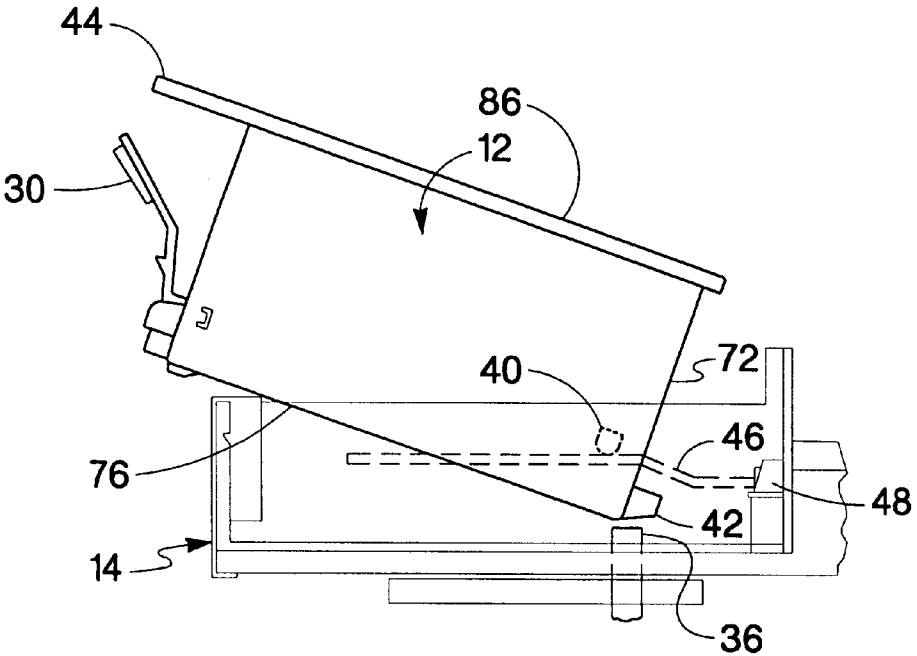

FIGS. 13*a* and 13*b* illustrate a position in the insertion process described with respect to FIGS. 9*a*, 9*b* and 9*c* wherein the leading edge 72 of the ink container 12 is positioned over the fluid interconnect 36. FIG. 13*a* depicts a side view of FIG. 13*b* showing an end view. It can be seen from FIGS. 13*a* and 13*b* that the guide feature 40 must be positioned on the ink container 12 low enough toward the bottom surface 76 of the ink container 12 such that the leading edge 72 of the ink container does not collide with the fluid interconnect 36 during insertion. Another constraint on the positioning of the guide member 40 is that the guide member 40 must be positioned sufficiently close to the top surface 86 of the ink container 12 to insure that the engagement feature 42 properly engages with the corresponding engagement feature 48 on the receiving station 14.

In addition, the outwardly extending guide members 40 on the ink container must extend outward sufficiently far to engage the guide rails 46. However, the outwardly extending guide members 40 should not extend too far outward such that the guide members 40 engage the upright sides in the receiving station 14, producing interference which produces friction and binding which resists insertion of the ink container 12 into the receiving station 14.

Figure 14A:
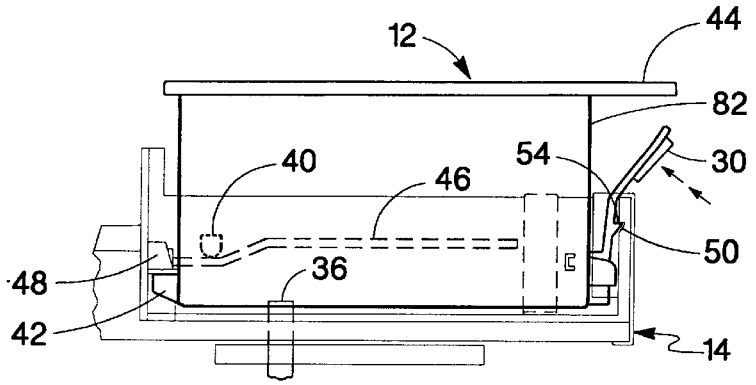
FIGS. 14*a*, 14*b* and 14*c* depict a method of the present invention for removing the replaceable ink container from the receiving station.
Figure 14B:
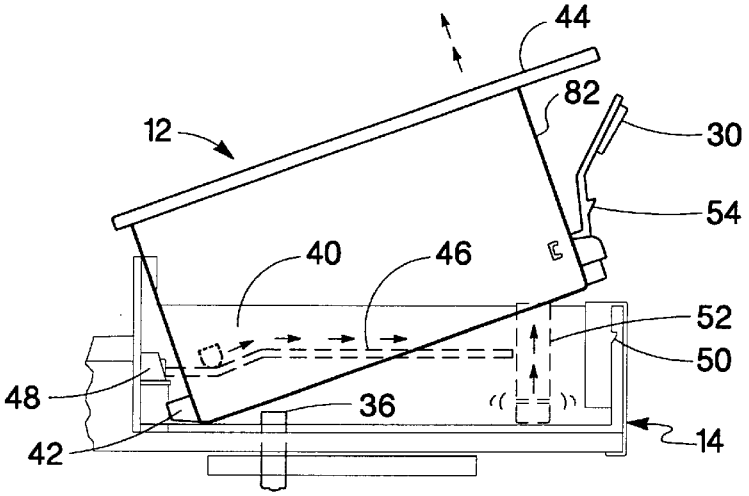
Figure 14C:
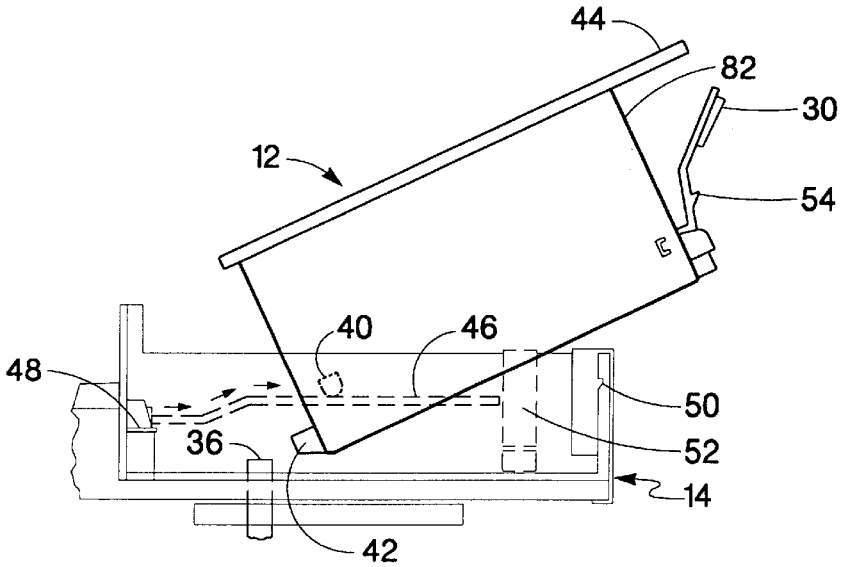

FIGS. 14*a*, 14*b*, and 14*c* illustrate the technique for removing the ink container 12 from the receiving station 14. The technique for removing the ink container 12 of the present invention begins with the release of the engagement feature from the corresponding engagement feature 50 on the receiving station 14 by urging the latch 30 toward the trailing surface 82. Once the trailing edge of the ink container 12 is released, the spring 52 urges the trailing edge of the ink container upward as shown in FIG. 14*b*. The ink container 12 can be grasped by handle 44 to retrieve the ink container 12 in a direction opposite the insertion direction. As the ink container 12 is withdrawn from the receiving station 14, the guide member 40 follows the guide rails 46 to lift the ink container, thereby preventing interference between the fluid interconnect 36 and the fluid outlet on the bottom surface of the ink container 12.

The ink container 12 of the present invention is configured to engage and interact with the receiving station 14 to guide the ink container 12 into the receiving station and for a reliable fluid and electrical connection with the receiving station 14. The technique of the present invention allows this insertion process to be relatively simple and easy to prevent improper insertion of the ink container 12. The customer grasps the ink container 12 by the handle portion 44 and slides the ink container 12 horizontally into the receiving station 14. The guide rails 46 and guide features 40 cooperate to properly guide the ink container 12 into the receiving station 14. The ink container 12 is pressed downwardly to latch the ink container 12 and achieve operational interconnection both electrically and fluidically between the ink container 12 and the receiving station 14.

What is claimed is:

1. A replaceable ink container for providing ink to an inkjet printing system, the replaceable ink container comprising:

an ink container housing having a leading edge relative to a direction of an insertion of the ink container housing into the inkjet printing system, the ink container housing including:

an engagement features disposed on the leading edge and configured for engagement with corresponding engagement features associated with the inkjet printing system, an interengagement of the engagement features with the corresponding engagement features defining a pivot axis about which the ink container housing pivots during the insertion into the inkjet printing system; and a plurality of electrical contacts disposed on the leading edge of the ink container housing at least partially below the pivot axis so that pivoting the ink container housing about the pivot axis during insertion causes the plurality of electrical contacts on the ink container housing to move toward corresponding electrical contacts associated with the inkjet printing system to establish an electrical interconnection therebetween.

2. The replaceable ink container of claim 1 wherein the inkjet printing system has a receiving station disposed on a scanning carriage and wherein the ink container housing is configured for insertion into the receiving station.

3. The replaceable ink container of claim 1 wherein the plurality of electrical contacts are four electrical contacts.

4. The replaceable ink container of claim 3 wherein the four electrical contacts include a pair of contacts for providing a supply voltage therebetween and a pair of contacts for providing control and data signals relative to a common reference.

5. The replaceable ink container of claim 1 wherein the inkjet printing system includes a scanning carriage that moves along a scan axis, the scanning carriage including a receiving station configured for receiving the ink container housing, and wherein with the ink container housing installed in the receiving station, the plurality of electrical contacts are disposed on the ink container housing in a side by side manner along a line parallel to the scan axis.

6. The replaceable ink container of claim 1 wherein the ink container housing has a bottom surface and an upright side connected to the bottom surface and defining the leading edge, and wherein the plurality of electrical contacts are disposed on the upright side between the bottom surface and the pivot axis.

7. The replaceable ink container of claim 1 wherein the plurality of electrical contacts are moved along an arc as the ink container housing is pivoted about the pivot axis to engage the corresponding electrical contacts associated with the inkjet printing system.

8. The replaceable ink container of claim 1 further including an electrical storage device that is electrically connected to the plurality of electrical contacts.

9. The replaceable ink container of claim 8 wherein the electrical storage device is a semiconductor memory device.

10. The replaceable ink container of claim 2 wherein the corresponding electrical contacts are spring biased electrical contacts associated with the receiving station, and wherein an insertion of the ink container housing into the receiving station biases each of the plurality of electrical contacts on the ink container housing into engagement with each of the spring biased electrical contacts on the receiving station to establish reliable electrical contacts therebetween.

11. A replaceable ink reservoir for installation into a printing system having a receiving station disposed on a moveable carriage for repositioning a replaceable printhead relative to print media, the receiving station having a bottom surface and a backwall having at least one electrical contact disposed thereon, the replaceable ink reservoir comprising:

a reservoir portion for containing a quantity of ink, the reservoir portion having a leading edge surface defined as that surface of the reservoir portion first received by the receiving station upon an insertion of the replaceable ink reservoir into the printing system;

engagement features disposed on the leading edge surface and configured for engagement with corresponding engagement features associated with the receiving station of the printing system, an interengagement of the engagement feature with the corresponding engagement features defining a pivot axis about which the replaceable ink reservoir pivots during the insertion into the printing system;

at least one electrical contact electrically connected to an electrical storage device, the at least one electrical contact disposed on the reservoir portion below the pivot axis; and wherein the insertion of the reservoir portion into the receiving station first in a linear direction toward the backwall and second in a direction to pivot about the pivot axis toward the bottom surface of the receiving station operatively couples the at least one electrical contact on the receiving station with the at least one electrical contact on the reservoir portion.

12. The replaceable ink reservoir of claim 11 wherein the reservoir portion has a bottom surface and an upright side connected to the bottom surface and defining the leading edge surface, and wherein the at least one electrical contact of the reservoir portion is disposed on the upright side between the bottom surface and the pivot axis.

13. The replaceable ink reservoir of claim 11 wherein the at least one electrical contact of the reservoir portion is four electrical contacts each electrically connected to the electrical storage device.

14. The replaceable ink reservoir of claim 11 wherein the reservoir portion further includes a bottom surface and at least one upright side, and wherein a fluid outlet is disposed in the bottom surface and the at least one electrical contact of the reservoir portion is disposed on the at least one upright side.

15. The replaceable ink reservoir of claim 11 wherein the movable carriage moves along a scan axis and wherein an insertion of the reservoir portion into the receiving station in the linear direction is orthogonal to the scan axis.

16. The replaceable ink reservoir of claim 11 wherein the reservoir portion further includes a bottom surface and at least one upright side which defines the leading edge surface, and wherein a fluid outlet is disposed in the bottom surface and the at least one electrical contact of the reservoir portion is disposed on the at least one upright side and wherein the engagement feature is disposed on the leading edge surface toward the bottom surface.

17. The replaceable ink reservoir of claim 11 wherein the reservoir portion further includes a bottom surface and at least one upright side, and wherein a fluid outlet is disposed in the bottom surface and the at least one electrical contact of the reservoir portion is disposed on the at least one upright side toward the bottom surface.

18. A method for achieving reliable electrical connection between a carriage-mounted replaceable ink container and a receiving station, the method comprising:

positioning the replaceable ink container at least partially within the receiving station such that an engagement feature on the replaceable ink container engages a corresponding engagement feature associated with the receiving station to define a pivot axis; and pivoting the replaceable ink container about the pivot axis to move at least one electrical contact on the replaceable ink container along an arc to engage and electrically couple with at least one electrical contact associated with the receiving station.

19. The method of claim 18 wherein the at least one electrical contact on the replaceable ink container is a plurality of electrical contacts, wherein the at least one electrical contact on the receiving station includes a plurality of corresponding electrical contacts, and wherein pivoting the replaceable ink container about the pivot axis moves each of the plurality of electrical contacts of the replaceable ink container along the arc to engage and electrically couple with each of the plurality of corresponding electrical contacts of the receiving station.

20. The method of claim 18 further including providing ink from the replaceable ink container to the receiving station.

21. The method of claim 18 further including transferring information between the replaceable ink container and the receiving station.

22. The method of claim 18 wherein positioning the replaceable ink container at least partially within the receiving station includes urging the replaceable ink container toward a backwall of the receiving station, the backwall having the at least one electrical contact disposed thereon.

23. The method of claim 18 wherein pivoting the replaceable ink container about the pivot axis includes pivoting the replaceable ink container downward toward a bottom surface of the receiving station to operatively couple a fluid outlet on the replaceable ink container with a fluid inlet proximate the bottom surface of the receiving station.

24. A replaceable ink container for providing ink to an inkjet printing system, the replaceable ink container comprising:

an ink container housing having a leading edge relative to a direction of an insertion of the ink container housing into the inkjet printing system, the ink container housing including:

engagement features disposed on the leading edge and configured for engagement with corresponding engagement features associated with the inkjet printing system, an interengagement of the engagement features with the corresponding engagement features defining a pivot axis about which the ink container housing pivots during the insertion into the inkjet printing system; and a plurality of electrical contacts disposed on the leading edge of the ink container housing at least partially below the pivot axis so that pivoting the ink container housing about the pivot axis during the insertion causes the plurality of electrical contacts on the ink container housing to move along an arc toward corresponding electrical contacts associated with the inkjet printing system to engage and establish an electrical interconnection therebetween.

25. A replaceable ink container for providing ink to an inkjet printing system, the inkjet printing system having a receiving station disposed on a scanning carriage, the replaceable ink container comprising:

an ink container housing having a leading edge relative to a direction of an insertion of the ink container housing into the receiving station of the inkjet printing system, the ink container housing including:

engagement features disposed on the leading edge and configured for engagement with corresponding engagement features associated with the inkjet printing system, an interengagement of the engagement features with the corresponding engagement features defining a pivot axis about which the ink container housing pivots during the insertion into the receiving station;

a plurality of electrical contacts disposed on the leading edge of the ink container housing at least partially below the pivot axis so that pivoting the ink container housing about the pivot axis during the insertion causes the plurality of electrical contacts on the ink container housing to move toward spring biased electrical contacts associated with the receiving station, and wherein the insertion of the ink container housing into the receiving station biases each of the plurality of electrical contacts on the ink container housing into engagement with each of the spring biased electrical contacts on the receiving station to establish reliable electrical contacts therebetween.

* * * * *

UNITED STATES PATENT AND TRADEMARK OFFICE

CERTIFICATE OF CORRECTION

PATENT NO. : 6,302,535 B1
DATED : October 16, 2001
INVENTOR(S) : Scott D. Sturgeon et al.

It is certified that error appears in the above-identified patent and that said Letters Patent is hereby corrected as shown below:

Column 1,
Line 5, (i.e. after the Title and before the Background Of The Invention) it should read:

-- Cross Reference to Related Applications
The present application is a continuation-in-part of U.S. Patent Application Serial No. 09/495,060 filed January 31, 2000, entitled "*Ink Container Configured To Establish Reliable Electrical And Fluidic Connections To A Receiving Station*" which has been assigned to the same Assignee as the present application. --

Signed and Sealed this

First Day of April, 2003

JAMES E. ROGAN
*Director of the United States Patent and Trademark Office*